US006195801B1

(12) United States Patent
Meyers

(10) Patent No.: US 6,195,801 B1
(45) Date of Patent: Mar. 6, 2001

(54) SWIM TRAINING APPARATUS

(76) Inventor: Kathleen Ann Meyers, 5125 Hagewa Dr., Blue Ash, OH (US) 45242

( * ) Notice: Subject to any disclaimer, the term of this patent is extended or adjusted under 35 U.S.C. 154(b) by 0 days.

(21) Appl. No.: 09/457,824

(22) Filed: Dec. 9, 1999

(51) Int. Cl.[7] ..... A41D 5/00
(52) U.S. Cl. ..... 2/67; 2/69; 434/254
(58) Field of Search ..... 2/67, 69, 227, 2/228, 238; 441/102, 103, 106, 107, 108, 109, 110, 111, 112, 113, 114, 120; 434/254

(56) References Cited

U.S. PATENT DOCUMENTS 3,744,052 * 7/1973 Rector ..... 2/2.15
4,946,453 * 8/1990 Monson ..... 604/312
5,033,116 * 7/1991 Itagaki et al. ..... 2/67
5,282,277 * 2/1994 Onozawa .
5,887,280 * 3/1999 Waring ..... 2/69

* cited by examiner

*Primary Examiner*—Gloria M. Hale
(74) *Attorney, Agent, or Firm*—Frost Brown Todd LLC

(57) ABSTRACT

A swim training apparatus worn by a swimmer is shown. It includes a garment sized and shaped cover at least a portion of swimmer's body and has first and second panels with contrasting tactile properties. One of the panels, preferably having a tactile-stimulating surface, is positioned on the garment such that the swimmer can feel the tactile differential as a guide to the swimmer's hand while practicing swim strokes.

15 Claims, 2 Drawing Sheets

SWIM TRAINING APPARATUS

I. TECHNICAL FIELD

This invention relates to a swim training apparatus in the form of a garment to be worn by a swimmer which provides guidance for the swimmer's hands during the learning of various strokes. Specifically, the garment has tactile-stimulating panels which can be felt by the swimmer's fingers as the hand brushes across the swimmer's body along the appropriate path.

II. BACKGROUND OF THE INVENTION

When teaching competitive swimming, it is important that each hand and arm movement be mastered for each stroke (freestyle, breast stroke, butterfly, etc.). One of the more difficult parts of teaching a swimming stroke is movement of the arms during the pushing or power phase of each stroke. Young swimmers arc shown stroke movements while standing vertically on dry land. This is very unlike moving forward horizontally through the water. Coaches can observe and critique swimming students while in action, but it is very difficult to provide real-time feedback as to whether each hand movement was executed correctly.

III. SUMMARY OF THE INVENTION

The present invention is an apparatus in the form of a garment which provides immediate feedback to a swimmer as to whether hands are properly positioned during the pushing or power portions of each stroke. It includes a garment sized and shaped to cover at least a portion of the swimmer's body, usually the torso section. The garment has first and second portions with contrasting tactile properties. For example, one portion may be smooth while the other is bumpy other is bumpy or ridged. The portions are positioned on the garment such that the swimmer can feel the tactile differential as a guide to the swimmer's hand while practicing swim strokes.

In one embodiment, a tactile-stimulating panel is applied to the front of the garment in an inverted Y-shape. A relatively narrow band of this material extends from the neckline straight down the chest, splitting apart and widening on the abdomen, and then wrapping around the side of the thighs. In this manner, the swimmer can use the tactile panel as a guide as the hand is moved down the center of the chest and then kept close against the body as the arm straightens and reaches the swimmer's thigh.

One of the problems often encountered by swimming students is the failure to keep the hand close against the body during the full stroke. The present invention provides a reminder to the swimmer in that the tactile panel should be felt with the hand during the entire stroke or during a particular portion of the stroke.

According to a preferred embodiment, one of the garment portions, preferably the portion which forms the guide, includes "dots" or "ridges" applied to the fabric in the form of a thermoplastic material, resin material, or the like. An example of an acceptable material treatment is often found on lightweight work gloves.

According to another aspect of the present invention, an additional tactile-stimulating panel may be applied to the outer thighs at the point where the hand is to make its final push or release. This additional panel may be in the form of a somewhat raised protrusion so that contact by the hand at that point is unmistakable.

Many other features and aspects of the present invention will become apparent upon inspection of the various figures of the drawing, review of the disclosed best mode for carrying out the invention, and the appended claims, all of which comprise the present disclosure.

IV. BRIEF DESCRIPTION OF THE DRAWING

Like referenced numerals arc used to refer to like parts throughout the various figures of the drawing, wherein.

V. BEST MODE FOR CARRYING OUT THE INVENTION

Figure 1:
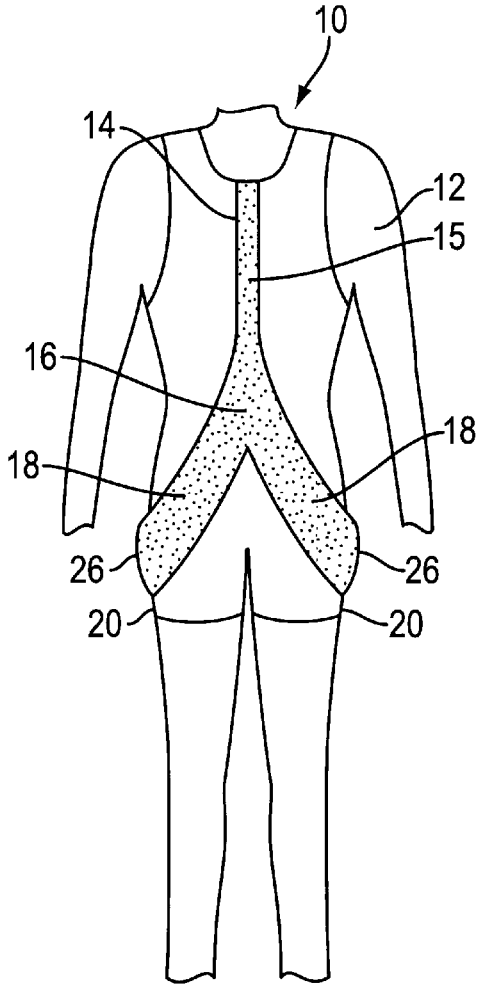
FIG. 1 is a front planar view of a preferred embodiment of the present invention as it would be positioned on a swimmer's body.

Referring now to the various Figures of the drawing, and first to FIG. 1, therein is shown at 10 a front planar view of a preferred embodiment of the present invention. In preferred form, the apparatus 10 is a garment made of stretch material, such as Lycra® spandex or lightweight neopreme. It is preferred that the arms and shoulders of the swimmer 12 be left uncovered, as well as the lower thighs and legs. The shape shown is often termed "shortie" when referring to a wet suit.

When the garment is made from lightweight stretch material, typically no heavier than that of a common swimsuit, entry can be made either through the neck opening or facilitated by a back zipper. It is expected that the garment 10 would be worn over a racing style swimsuit for training purposes, although it is possible that it could be worn in the place of a swimsuit.

On the garment 10 is a panel of material having a tactile-stimulating texture. The texture of this panel 14 contrasts with the remainder of the garment, effectively creating a guide for the swimmer's hand or fingers as they are moved along the body.

Figure 2:
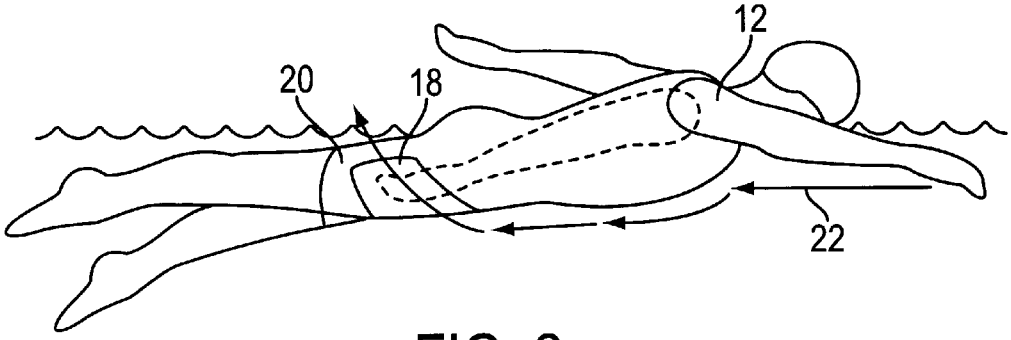
FIG. 2 is a side view of a swimmer moving through the water using a freestyle stroke showing the arm movement of the power or pushing portion.

The particular placement of the tactile-stimulating panel or panels will depend to some extend on which swimming stroke (freestyle, breast stroke, butterfly, etc.) is being taught. The illustrated example is particularly suitable for the freestyle stroke. The panel 14 is substantially in the shape of an inverted Y in which a leg extends straight down the center of the chest from the neckline to the abdomen, then widens 16 and splits 18 curving around to the outer thigh 20. This creates a guide for each hand to follow along in contact with the swimmer's body. The gross movement of this stroke is illustrated in FIG. 2 with arrows 22.

Figure 3:
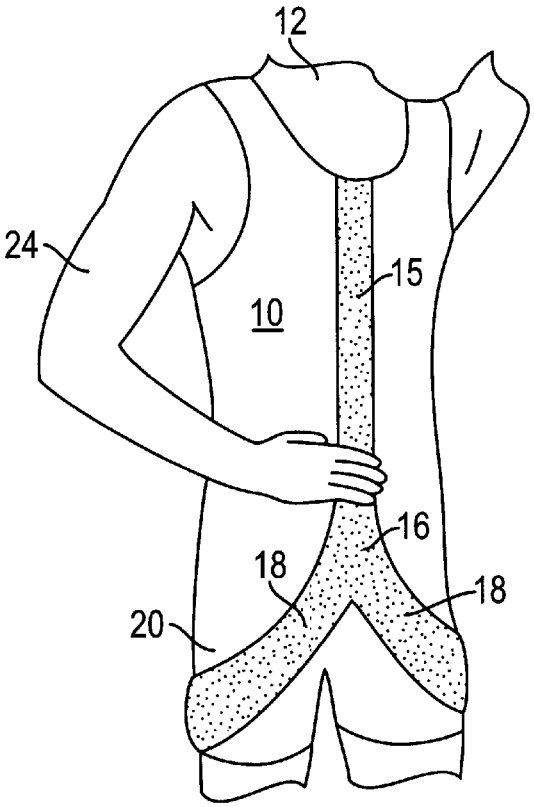
FIG. 3 is a view similar to FIG. 2, focusing on the swimmer's torso and taken from substantially underneath the swimmer as the arm moves across the middle of the torso.
Figure 4:
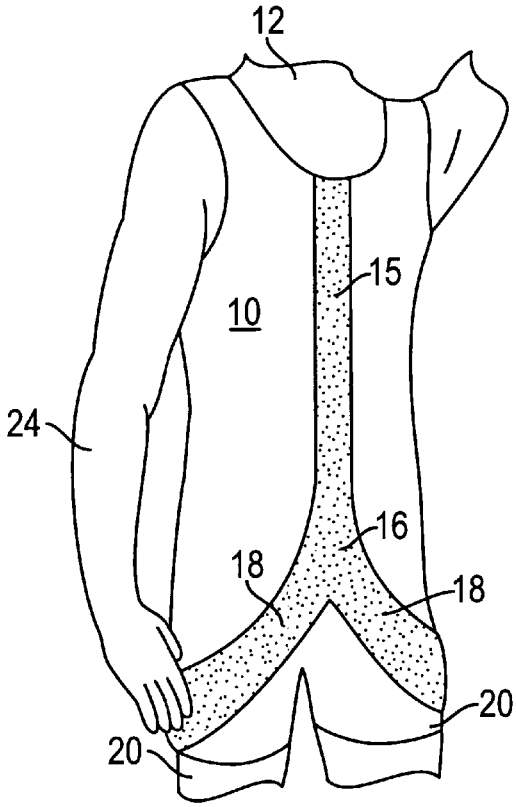
FIG. 4 is a view similar to FIG. 3, showing the arm at the final push or release position.

Referring now also to FIGS. 3 and 4, therein is shown in more detail the movement of the swimmer's arm 24 down the length of the chest panel 15 to the widened portion 16. (FIG. 3), and on to the split portion 18 at the outer thigh 20 (FIG. 4). In this manner, the swimmer 12 can follow a tactile guide along the correct stroke path while actually practicing swimming movements in the water.

It is recognized that the apparatus 10 and tactile-stimulating panel 14 may create undesirable drag on the swimmer while moving through the water. This is not a problem because the apparatus 10 is intended only for training and practice use.

It is to be understood that the panel 14 which creates the guide may be smooth relative to the remainder of the garment so long as an appropriate contrast is created there between. It is preferred, however, that only the stroke guide panel 14 be covered with nubs or ridges. These can be created by the weave of the fabric, by sewing treatment, or by application of a separate material to form studs, bumps, nubs, or ridges. In preferred form, these may be "dots in the form of a thermoplastic material, resin material, or the like applied to the outer surface of the fabric in a regular or irregular pattern. An example of an acceptable material treatment is often found on lightweight work gloves to provide an increased friction surface.

According to another aspect of the invention, additional protrusions 26 may be applied along the outer thigh 20 portion, approximately where the split part 18 of the tactile portion ends. This additional ridge or bump may be created by padding, quilting or application of an appropriate thicker material, such as neoprene. The purpose of this extended portion 26 is to provide certain stimulus at the end of the power movement of certain strokes, such as that illustrated in FIG. 4.

Many other variations and modifications may be made to the present invention without departing from its spirit and scope. Therefore, patent protection is not to be defined by the presently-disclosed preferred embodiment, but rather by the following claim or claims interpreted according to accepted doctrines of claim interpretation, including the doctrine of equivalence and reversal of parts.

What I claim is:

1. A swim training apparatus to be worn by a swimmer, comprising:

a garment sized and shaped to cover at least a portion of the swimmer's body, the garment having first and second panels with contrasting tactile properties, one of the panels being positioned on the garment such that the swimmer can feel the tactile differential as a guide to the swimmer's hand while practicing swim strokes, wherein one of the panels is applied to a front portion of the garment substantially in the shape of an inverted Y in which a straight portion extends substantially along a center line of the swimmer's chest, splits into separate diverging areas substantially at the swimmer's abdomen, and extends downwardly and outwardly substantially to the swimmer's outer thighs.

2. The apparatus according to claim 1, wherein the panel substantially in the shape of an inverted Y has a tactile-stimulating texture.

3. An apparatus according to claim 1, further comprising laterally-extending protrusions positioned substantially at the ends of the diverging portion at the swimmer's outer thighs.

4. A swim training, apparatus to be worn by a swimmer, comprising:

a garment sized and shaped to cover at least a portion of the swimmer's body, the garment having first and second panels with contrasting tactile properties, one of the panels being positioned on the garment such that the swimmer can feel the tactile differential as a guide to the swimmer's hand while practicing swim strokes, wherein the garment substantially covers the swimmer's torso, leaving the swimmer's arms and lower legs substantially uncovered and wherein one of the panels is applied to the front of the garment substantially in the shape of an inverted Y in which a straight portion extends substantially along a center line of the swimmer's chest, splits into separate diverging areas substantially at the swimmer's abdomen, and extends downwardly and outwardly to the swimmer's outer thigh.

5. An apparatus according to claim 4, further comprising laterally-extending protrusions positioned substantially at the ends of the diverging portion at the swimmer's outer thigh.

6. A swim training apparatus to be worn by a swimmer, comprising:

a garment sized and shaped to cover at least a portion of the swimmer's body, the garment having at least one panel with tactile properties contrasting with adjacent areas of the garment to create a tactile differential therebetween, said panel being shaped and positioned on the garment to define a guide path along which the swimmer can feel the tactile differential as a guide path for at least one of the swimmer's limbs during, at least a significant portion of a properly executed swim stroke.

7. An apparatus according to claim 6, wherein the panel includes a tactile-stimulating surface.

8. An apparatus according to claim 6, wherein the tactile differential is created by applying a tactile-stimulating material to a selected portion of the garment.

9. An apparatus according to claim 6, wherein the garment substantially covers the swimmer's torso, leaving the swimmer's arms and lower legs substantially uncovered.

10. A swim training apparatus to be worn by a swimmer, comprising:

a garment sized and shaped to cover at least a portion of the swimmer's body the garment having a guide means on the surface thereof, said guide means including tactile properties contrasting with substantially the remainder of the garment and said guide means being positioned such that the swimmer can feel the tactile differential as a guide to the swimmer's hand while practicing swim strokes, wherein the guide means is substantially in the shape of an inverted Y in which a straight a portion extends substantially along a center line of the swimmer's chest, splits into separate diverging areas substantially at the swimmer's abdomen, and extends downwardly and outwardly substantially to the swimmer's outer thighs.

11. An apparatus according to claim 10, wherein the guide means includes a tactile-stimulating surface.

12. A swim training, apparatus to be worn by a swimmer, comprising:

a garment sized and shaped to cover at least a portion of the swimmer's body and having a guide means on the surface thereof, said guide means including an area having tactile properties contrasting with adjacent portions of the garment and that is shaped and positioned to indicate a stroke path for at least one of the swimmer's limbs during at least a significant portion of a properly executed swim stroke.

13. An apparatus according to claim 12, wherein the guide means includes a tactile-stimulating surface.

14. An apparatus according to claim 12, further comprising laterally-extending means positioned on the garment at the swimmer's outer thighs for providing additional stimulus to the swimmer's hand as it passes that location.

15. An apparatus according to claim 12, wherein the guide means includes a tactile-stimulating surface comprising a separate means applied to fabric to create discreet surface irregularities.

* * * * *